United States Patent [19]

Fackelmann

[11] 4,179,752

[45] Dec. 25, 1979

[54] PROTECTIVE SUIT

[76] Inventor: Peter Fackelmann, Am Haenisgraben 27, Dieburg D-6110, Fed. Rep. of Germany

[21] Appl. No.: 881,507

[22] Filed: Feb. 27, 1978

[30] Foreign Application Priority Data

Mar. 18, 1977 [DE] Fed. Rep. of Germany ... 7708471[U]

[51] Int. Cl.[2] ..... A41D 13/00

[52] U.S. Cl. ..... 2/2; 2/227

[58] Field of Search ..... 2/69, 2 R, 2.5, 22, 2/23, 24, 227; 428/224, 225, 911; 112/420, 428

[56] References Cited

U.S. PATENT DOCUMENTS

| | | | |
|---|---|---|---|
| 1,144,150 | 6/1915 | Marcovsky | 2/2 |
| 1,654,452 | 12/1927 | Bradley | 2/23 |
| 3,594,817 | 7/1971 | Kelly | 2/2 X |
| 3,984,142 | 10/1976 | Van Valkenburgh | 2/2 |
| 4,035,844 | 7/1977 | Atack et al. | 2/2 |
| 4,059,852 | 11/1977 | Crane | 2/2 |

OTHER PUBLICATIONS

Velcro Product News, Velcro Corp., N.Y., N.Y., 10022.

*Primary Examiner*—Henry Jaudon
*Assistant Examiner*—Andrew M. Falik
*Attorney, Agent, or Firm*—Michael J. Striker

[57] ABSTRACT

A protective suit is provided in order to protect the wearer from skin abrasions as he slides along or otherwise comes in contact with a rough surface. The protective suit includes an outer material as well as a lining. Intermediate these are a plurality of layers of a material having a surface with a low coefficient of friction. Each of the layers of material has a high breaking elongation.

7 Claims, 2 Drawing Figures

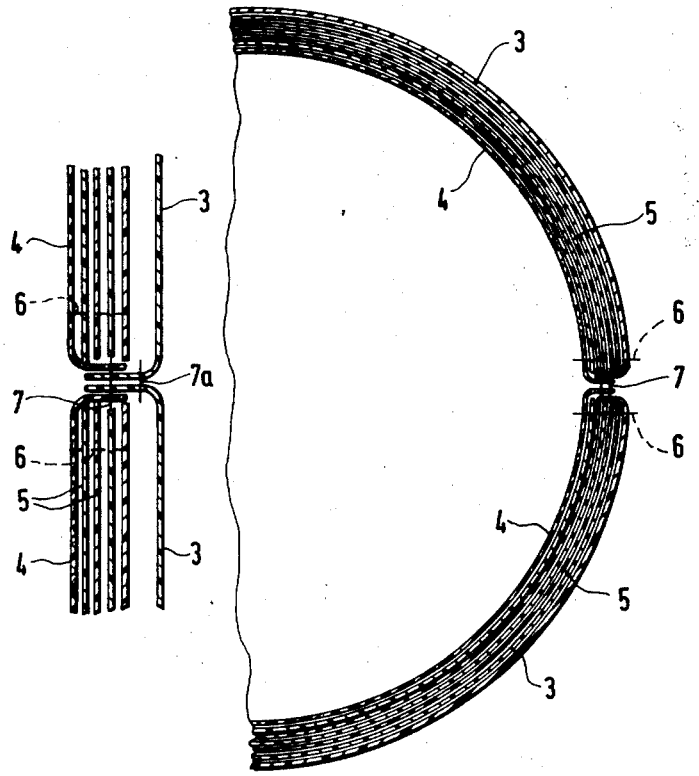

PROTECTIVE SUIT

BACKGROUND OF THE INVENTION

The present invention relates to garments. More particularly, the invention relates to a protective suit useful for industrial, business and sport application and is particularly intended for motorcyclists. Still more particularly, the invention relates to a suit of this type which has protective material between an outer material and a lining.

Up to now, leather is customeraly used as an outer material in such protective suits or garments. The leather is meant to protect against skin lacerations and similar injuries, for example in case of a fall from a moving motorcycle. It is conventional to provide padding in some parts of the protective clothes—for example, the elbows, the knees and the shoulders. This padding can also be backed with a polytetrafluoroethylene (PTFE) fiber material or fabric.

It has been found, however, that leather alone offers very little protection from skin abrasions and analogous injuries. Even materials with a higher strength and/or a higher slippage action—such as PTFE-fabric—fail to diminish the danger of skin abrasions.

Tests have shown that such fabrics, including for instance even polyamide fabrics, despite a high strength and slippage action, very quickly wear away due to friction when they contact a rough surface—e.g. by sliding on a road surface—; consequently, hardly any protection against abrasion is achieved by wearing such garments.

SUMMARY OF THE INVENTION

An object of the invention is to provide a protective suit which is capable of strongly withstanding frictional stress, particularly when the wearer slips on a road surface or some similar surface. This friction resistance must last for as long as possible before the suit is completely worn away at the surface-contacting portions of the suit—before the wearer's skin comes directly into contact with the street surface of the like.

In accordance with this and still further objects, protective material is inserted between the lining and the outer material of a suit according to the invention. This protective material consists of several layers of material lying at least substantially freely on each other. Each individual layer has a high breaking elongation and the material forming each layer has a surface having a low coefficient of friction; therefore the coefficient of friction between the individual layers of protective material is low.

When the protective garment is subjected to high frictional stress—for example, when a motorcyclist slides across a rough road surface—the outer material of the protective garment is very quickly destroyed wherever it is in significant contact with the rough surface. This rapid destruction occurs practically regardless of the kind of material which is used. It is to be recognized that only the construction and selection of the layers of protective material is decisive as to how long a wearer can slide before skin abrasions occur.

The protective mechanism of the inventive garment concept is that the layers of protective material which lie completely or substantially completely free on each other are individually and successively destroyed by friction. There is a low coefficient of friction between the individual layers of material and, also, this material has a coefficient of friction lower than that of the rough surface, e.g., a road. Because of this low coefficient of friction between the individual layers, the outermost layer is stressed up to destruction before stress occurs in the next layer which can move freely or almost freely with respect to any adjacent layer. The friction operates against only one layer at a time and is not transmitted to another layer until the one layer has been torn. The inventive concept further provides that the individual layers of material having a high breaking elongation. Breaking elongation is the increase in length of a material at the breaking load. This means that the outermost layer undergoes a relatively large deformation before it is destroyed by friction. As the material is stretched by engagement with the rough surface, energy is consumed; consequently, the frictional motion is retarded.

By providing the suit with more layers of the protective material, one upon the other, the distance over which the wearer can slide, before the protective material wears out at the area in contact with the surface, can be correspondingly increased and the wearer can thereby be saved from suffering skin abrasions. Due to the extension (stretching) of the material of the protective layer when they come successively in contact with the surface, a braking action results which ends the slide of the wearer relatively quickly. This braking action helps to prevent frictional force from lasting long enough to wear away the last protective layer; therefore, injury to the wearer is minimized.

Advantageously, the individual layers of material are connected to each other only at their edges and are only connected to the lining of the protective suit. This design allows the outermost layer of protective material to be deformed up to breakage without any stress being placed on the next layer. Connecting the layers only at their edges hardly impedes this desired free mobility; but this connection keeps the layers of protective material in their intended place and in an unstressed condition.

Advantageously, the layers of material forming the protective material are produced from fibers which are interlaced with each other. This offers the possibility of attaining excellent breaking elongation properties because the interlaced textile structure can itself undergo significant stretching before stretching of its actual fibers begins. The extension of the textile is an additional energy consumer. Tearing can only take place when the fibers themselves are fully stretched up to the breaking point.

Advantageously, the protective layers of material are formed of a spun-laced or spun-bonded product.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
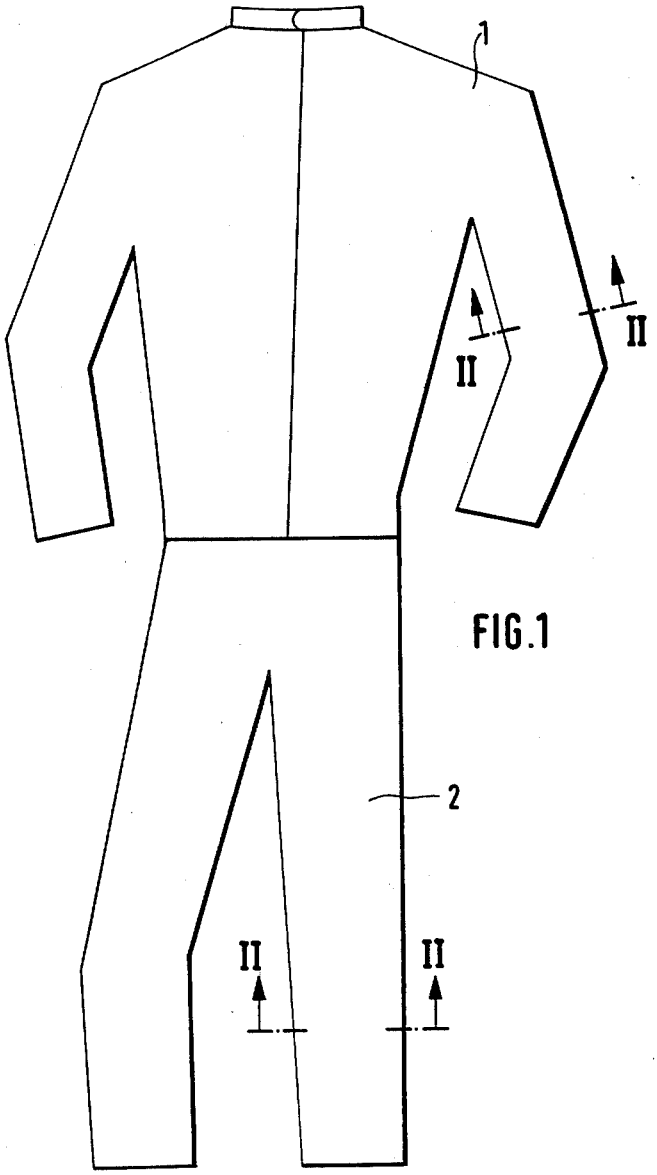
FIG. 1 is a schematic representation of a protective suit for, e.g., a motorcyclist.
Figure 2:
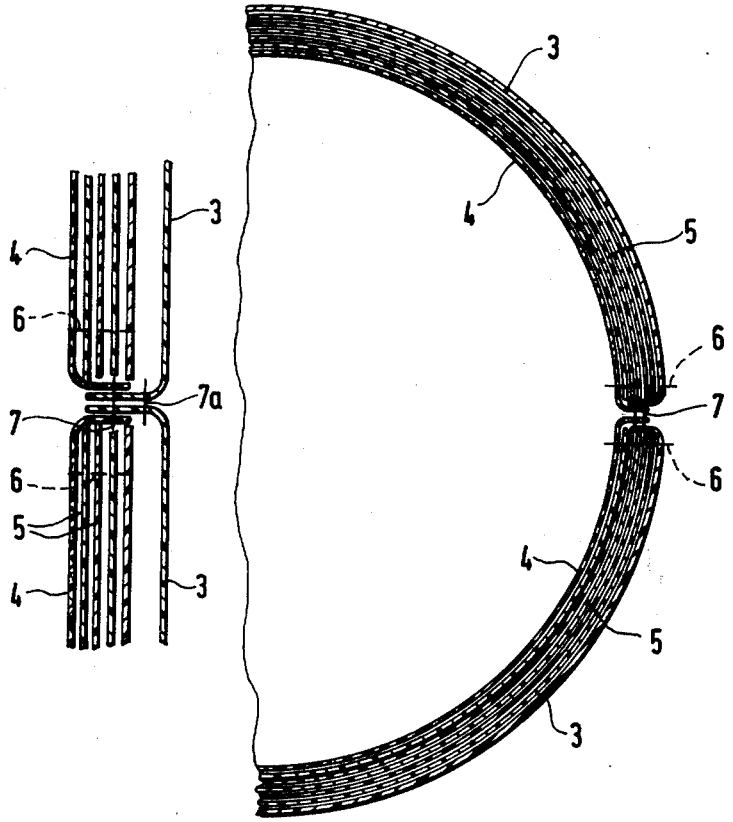
FIG. 2 is an enlarged partial section on line II—II of FIG. 1.

The protective suit shown in FIG. 1 consists of an upper part 1 and pants 2. However, the suit could be designed as a one-piece construction in accordance with the inventive concept. The protective suit can be manufactured in accordance with customary patterns. The partial section of FIG. 2, shows a cross-section through a sleeve or through a leg of the pants of the suit of FIG. 1. Polyamide fabric is an example of a suitable material for the outer fabric 3. The inwardly lying lining 4 consists of a synthetic resin fiber fabric of any of the types used conventionally in garment linings. Several layers of material 5 lie intermediate the outer material 3 and the lining 4; this material 5 forms the protective material. The individual layers of material 5 are respectively connected to the lining 4 by a seam 6 at their edges. The lining 4 is connected to the outer material 3 by a seam 7. As shown in the enlarged partial section at the left in FIG. 2, a further seam 7*a* can be provided in order to connect the two parts of the outer material 3 with each other.

FIG. 2 shows only three layers of material 5 for the sake of simplicity. In practice, a greater number of layers of material will be used—for instance eight or ten—in order to achieve a particularly effective protective action.

A large number of materials can be used as the protective material 5 since many materials have the requisite properties. The layers of material 5 are preferably made of a so-called "spun-laced" product. The "spun-laced" products constitute a strong unbounded fabric structure produced by entangling fibrous material together in a predetermined repeating pattern. The spun-laced products may be based on polyester fibers; however, they can be formed from a variety of fibers, including blends. The layers can also be made of a spun-bounded fabric. It is important that the material be strong. The material is produced through the interlacing of fibers in accordance with a closely layered, repeated pattern. The material 5 consists preferably of polyester fibers and has a particularly high tear resistance and a high breaking elongation; the breaking elongation can amount to more than 100% with appropriate selection of the material. The individual layers of material 5 can easily slip over each other so that the outermost layer of material 5 can be stretched to breaking before the stretching begins on the next layer 5. The next layer 5 is held in its place by the seam 6.

The described application of such a protective suit is of special importance to motorcyclists, since they are especially exposed to the danger of skin abrasions when tumbling to the road. The inventive protective suit is useful all over in such fields as industry, transportation, trade and sports wherever there is a danger that a part of the human body may come into frictional contact with a rough surface. It is important to understand that the layers 5 only individually act as padding to protect against impact. Their primary purpose, as explained before, is to prevent the skin of the wearer from coming in contact with the rough surface. Since they do this by successively undergoing destruction due to sliding friction, their action may be thought of as analogous to the ablative heat shields on space reentry vehicles.

The type of production is not by itself decisive for the choice of material for the layers of material 5. For example, the material can be textile material, woven material, knitted material or a non-woven textile material. Also, fleece or even foils can be used to form the protective material, provided that the chosen material possesses the required high breaking elongation and a low coefficient of friction.

In addition, a high thermal resistance can be desirable for the material of the layers 5. Using a material having this property diminishes damage due to frictional heat. The outer material 3 itself may be a material having the same properties—namely high breaking elongation and a low coefficient of friction vis-a-vis the layer of material 5 located inwardly adjacent to it.

It will be understood that each of the elements described above, or two or more together, may also find a useful application in other types of protective suits differing from the types described above.

While the invention has been illustrated and described as embodied in constructions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A protective suit comprising, in combination, an outer material; a lining; and a plurality of layers of protective material intermediate said outer material and said lining and lying upon each other with a low coefficient of friction between each of the layers, each of said layers having edges, said layers being connected only at their edges to each other and to said lining, said layers each having a high breaking elongation whereby when an individual layer of protective material is stretched after directly contacting a rough surface, another individual layer directly beneath it remains at least substantially unstressed due to the low coefficient of friction at least until the first-mentioned individual layer is worn away.

2. The suit defined in claim 1, at least some of said layers consisting of fibers which are interlaced with each other.

3. The suit defined in claim 2, at least some of said layers being a spun-bonded fabric.

4. The suit defined in claim 2, at least some of said layers consisting of polyester fibers.

5. The suit defined in claim 1, at least some of said layers being a spun-laced fabric.

6. The suit defined in claim 1, said outer material being likewise a material having a high breaking elongation and a low coefficient of friction.

7. The suit defined in claim 1, said plurality of layers comprising eight of said layers.

* * * * *